United States Patent [19]

Orlandini

[11] Patent Number: 4,957,234

[45] Date of Patent: Sep. 18, 1990

[54] CUTTING DEVICE FOR ROLLS OF ADHESIVE TAPE

[76] Inventor: Giorgio Orlandini, Via Marinelli 39, Camerano (AN), Italy

[21] Appl. No.: 201,850

[22] Filed: Jun. 3, 1988

[51] Int. Cl.[5] ..... B65H 35/07

[52] U.S. Cl. ..... 225/65; 225/56

[58] Field of Search ..... 225/58, 65, 56, 25, 225/55, 66, 71

[56] References Cited

U.S. PATENT DOCUMENTS

| | | | |
|---|---|---|---|
| 2,655,214 | 10/1953 | Van Cleef | 225/65 |
| 2,717,641 | 9/1955 | Wiederspan | 225/65 |
| 2,999,313 | 9/1961 | Emmert | 225/65 |
| 3,069,105 | 12/1962 | Press et al. | 225/66 |
| 3,395,841 | 8/1968 | Brown | 225/65 |

FOREIGN PATENT DOCUMENTS

| | | | |
|---|---|---|---|
| 767490 | 9/1967 | Canada | 225/56 |
| 8419340 | 10/1984 | Fed. Rep. of Germany . | |

*Primary Examiner*—Hien H. Phan

*Attorney, Agent, or Firm*—Leonard Bloom

[57] ABSTRACT

A device is disclosed for the precise and rapid cutting of adhesive tape that is wound in rolls on reels. The device includes a runner with a transversal cutting blade at the top. The runner is externally clamped to the roll of adhesive tape by means of an elastic band that is placed transversally over the top of the runner. The band is hooked at opposite sides within concave annular grooves formed at both ends of a pin. The pin, in turn, is disposed extending through the reel around which the adhesive tape is wound.

3 Claims, 1 Drawing Sheet

CUTTING DEVICE FOR ROLLS OF ADHESIVE TAPE

DESCRIPTION TEXT

This patent application for an industrial invention concerns a device for the precise and rapid cutting of adhesive tape wound in rolls, suitable for application, on rolls of any diameter, provided that the width of the tape is the same.

Similar devices which are currently available generally consist of a supporting element for the roll of adhesive tape, comprising a single pin or two coaxial pins, opposite each other, on which the roll is loosely positioned and a transversal toothed section, where the cutting of the tape, which has been previously unwound takes place.

In this type of device, pulling action on the strip of adhesive tape brings about its subsequent unwinding, following rotation of the roll around its fixed central pin.

The cutting of the piece of unwound tape takes place by pulling it towards and pressing it over the top of the abovementioned fixed toothed section, which then cuts it transversally.

The device according to the invention, notably distinguishes itself from all the other equivalent devices already in existence, since it is based on totally contrasting working principles.

In fact, in the device in question, there is no support or central pin for the roll of adhesive tape. The roll must be gripped in one hand, while the other hand is used to pull the strip of adhesive tape. As it unwinds, it causes the runner on the outside of the roll to slide along, while the roll stays firm, held between the fingers.

This runner, which has side guides on the bottom, to avoid any transversal displacement on the outer surface of the roll, has a transversal toothed cutting blade on the top, which, according to the direction in which the runner advances during unwinding of the tape, is immediately followed by a transversal slot, from which the adhesive tape emerges. This unwinding brings about a forward push on the runner, which is kept continually pressed to the outside of the roll by an elastic band, which goes over the top of the runner transversally and is hooked at opposite sides within two annular grooves, specially made at the two ends of a cylindrical pin, which juts slightly from the inside surface of the reel around which the adhesive tape is wound. As the runner advances, sliding along the outside of the roll of adhesive tape, the abovementioned pin moves forwards, touching the inside surface of the supporting reel at the same angular velocity.

When pulling action on the strip of adhesive tape ceases, unwinding is interrupted and likewise the advancement of the runner along the outside of the roll.

By folding the piece of unwound tape forwards over the roll, it comes immediately into contact with the cutting blade on the top of the runner, which instantly cuts the tape transversally in a precise manner.

After the cutting of the tape, a small piece of adhesive tape is left jutting out of the transversal slot on the runner near the blade. This small piece is part of the strip and is to be gripped for unwinding the next piece of tape.

For further clarity of explanation, the description of the invention continues with reference to the attached drawings, which are reproduced for illustrative and not restrictive purposes, in which.

Figure 1:
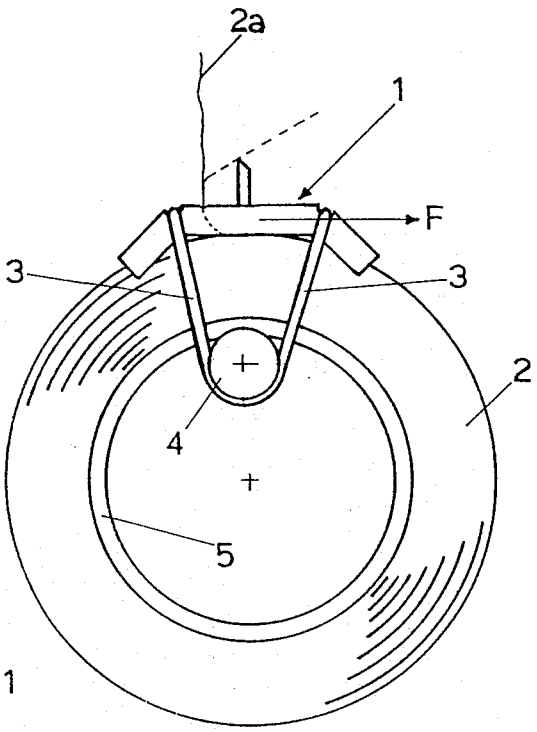
FIG. 1 is a side view of the device according to the invention, fitted on a roll of adhesive tape.
Figure 2:
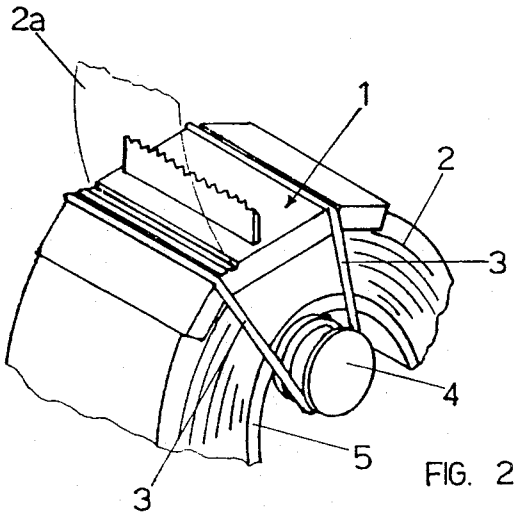
FIG. 2 is an axonometric reproduction of the device according to the invention, fitted on a roll of adhesive tape, which is partially represented.
Figure 3:
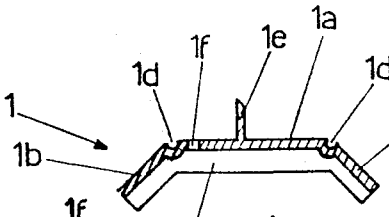
FIG. 3 is the section of FIG. 4, showing the longitudinal plane A—A.
Figure 4:
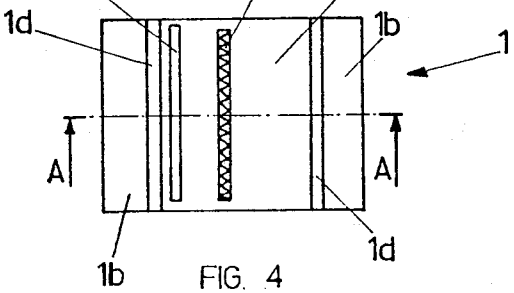
FIG. 4 is the plan of the outside of the device in accordance with the invention.
Figure 5:
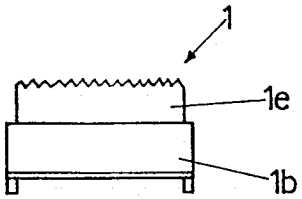
FIG. 5 is FIG. 4 seen from left to right.
Figure 6:
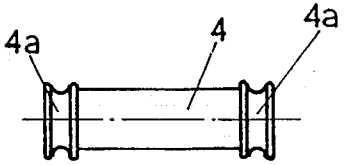
FIG. 6 is the pin part of the device, in accordance with the invention.

With reference to the abovementioned figures, the cutting device, in accordance with the invention is composed of a runner (1), preferably made of moulded plastic, with a central rectangular flat section (1*a*), and two identical symmetrical inclined surfaces (1*b*), one at the front and one at the back, in relation to the direction in which the runner slides along the outside of the roll (2) of adhesive tape (2*a*).

On both longitudinal sides, the flat section (1*a*) and the inclined surfaces (1*b*), have a guiding edge (1*c*), with the function of preventing the runner (1) from sliding sideways onto the roll (2) of adhesive tape (2*a*) underneath. On the top of the runner (1), along the two edges where the central flat section (1*a*) and the inclined planes (1*b*) meet, there are two transversal grooves (1*d*), into which the elastic band (3) that holds the runner (1) onto the outside of the roll (2) of adhesive tape (2*a*) is inserted.

Said elastic band (3) passes over the top of the runner (1) along the two aforementioned grooves (1*d*) and is hooked at opposite sides, within the circular grooves (4*a*) provided for this purpose at the two protruding edges of a pin (4), positioned inside the reel (5), around which the adhesive tape (2*a*) is wound.

Said pin (4) is kept in place inside the reel (5) by the internal raised edges of the grooves (4*a*).

From the central flat section (1*a*) of the runner (1), there projects approximately in the centre, a transversal cutting blade (1*e*), which has a serrated edge.

Immediately behind the cutting blade (1*e*), according to the direction of movement of the runner (1) along the roll (2) during the unwinding of the adhesive tape (2*a*), indicated by the arrow (F) in FIG. 1, there is a transversal slot (1*f*), from which the strip of adhesive tape (2*a*) emerges from under the runner.

The simplicity and practicality of the cutting device in accordance with the invention is now clear; it can be used on rolls of adhesive tape of any diameter, provided that the width of the tape is the same.

It is equally evident that the instant invention is easy to make and the manufacturing costs are consequently very low, clearly lower than those of any other equivalent device currently on the market.

I claim:

1. Device for cutting a roll of adhesive tape wound on a reel, said device comprised of:

a runner having a central flat section including a pair of opposite ends, two equal symmetrical inclined planes that bear lateral guiding edges, each inclined plane being positioned at a respective opposite end of the flat section, so that respective opposite end edges are defined therebetween, two transversal grooves formed along the opposite end edges where the central flat section and the inclined planes meet, a transversal cutting blade having a serrated edge protruding from the top of the flat section, the flat section having a transversal slot formed therein near the cutting blade from which the strip of adhesive tape emerges;

a pin including a pair of ends, the pin having two circular grooves formed therein, one at each end thereof, the pin having a length, such that said grooves protrude from either side of the reel, onto which the roll of adhesive tape is wound and through which the pin is inserted;

an elastic band, which passes over the runner the transversal grooves and is hooked at opposite sides to the two circular grooves of the pin inserted in the reel, around which the adhesive tape is wound.

2. A device for cutting adhesive tape wound on a reel, said device comprised of:

a runner having a central section including a pair of opposite ends and a pair of inclined planes, each of the inclined planes being joined to a respective opposite end of the central section, so that a respective edge is defined therebetween;

the runner having a pair of grooves formed therein, each groove formed extending along a respective edge;

the runner having a slot formed therethrough which adhesive tape wound on the reel passes during unwinding in the use thereof;

a pin including a pair of opposite ends, each of said opposite ends having a respective concave groove formed therein, the pin being disposed extending through the reel on which the adhesive tape is wound, so that the opposite ends protrude from the reel and are spaced therefrom;

an elastic band received and retained in each of the grooves formed in the opposite ends of the pin and in each of the grooves formed in each of the respective edges of the runner, whereby the runner is urged against the adhesive tape wound on the reel and further whereby the elastic band is spaced from the adhesive tape and the reel; and means for cutting the adhesive tape that has been unwound from the reel and passed through the slot, such that a desired length of adhesive tape is provided.

3. The device of claim 2, further comprised of:

the runner further having a pair of opposite lateral edges, each of said lateral edges including a downwardly-extending lateral guide, such that when the runner is disposed and retained on the adhesive tape wound on the reel the lateral guides laterally embrace the adhesive tape wound on the reel, whereby transversal displacement of the runner is prevented.

* * * * *